United States Patent [19]

Drexhage

[11] Patent Number: 4,553,278

[45] Date of Patent: Nov. 19, 1985

[54] TIP-UP BED AND POST TENSIONED BEDDING RETAINER

[76] Inventor: Gerrit K. Drexhage, 910 Centera Way, Mill Valley, Calif. 94941

[21] Appl. No.: 603,490

[22] Filed: Apr. 24, 1984

[51] Int. Cl.[4] ..... A47C 17/38

[52] U.S. Cl. ..... 5/136; 5/159 R

[58] Field of Search ..... 5/133, 136, 137, 159 R, 5/162, 164, 163, 166, 58

[56] References Cited

U.S. PATENT DOCUMENTS

| | | | |
|---|---|---|---|
| 158,986 | 1/1875 | Schwartz et al. | 5/136 |
| 220,173 | 9/1879 | Rieckert | 5/164 D |
| 451,842 | 5/1891 | Potter | 5/164 R |
| 2,588,071 | 3/1952 | Arton | 5/58 |
| 4,476,592 | 10/1984 | Reppas et al. | 5/136 |

*Primary Examiner*—Alexander Grosz

*Attorney, Agent, or Firm*—Thomas S. MacDonald; Alan H. MacPherson; Steven F. Caserza

[57] ABSTRACT

A pillow and bedding retainer for a made-up tip-up bed (11) includes a flexible concave panel (21) extending across a bed storage recess (14). The panel is freely mounted in a parallel spaced pair of horizontal open channels (22, 23) attached to a pivot frame (9) forming a bedding cavity (40). As bed (11) is tilted from a horizontal position (A) to a vertical position (C) through an intermediate position (B) the upper edge (24) of the head of a mattress (13) slidingly engages and presses the panel rearwardly further into the storage recess and tensions the pillow and upper bedding portions against the mattress head top surface retaining them in a diminishing volume of the cavity. The center of curvature of the panel is displaced from the pivot axis (30) of the bed and the panel has a radius of curvature greater than the radius of curvature of the bed pivot axis.

9 Claims, 3 Drawing Figures

TIP-UP BED AND POST TENSIONED BEDDING RETAINER

CROSS-REFERENCES TO RELATED APPLICATIONS

This invention may employ the torsion bar pivoting, construction shown in my application Ser. No. 603,489 filed concurrently herein and entitled Adjustable Torsion Bar Assembly which application is herein incorporated by reference.

BACKGROUND OF THE INVENTION

1. Field of the Invention

This invention relates to a tip-up bed which is pivotably movable from a horizontal position to a vertical storage position combined with a bedding and pillow retainer for retaining bedding and pillow(s) against a mattress top surface when the bed is tilted from its horizontal use position to its vertical storage position.

2. Description of the Prior Art

U.S Pat. Nos. 3,386,110, 4,070,715 and 4,318,195 all show tip-up bed constructions more particularly combinations of tip-up beds with auxiliary furniture units which are moved by appropriate pivoting such as torsion bars to and from a horizontal use position to a vertical storage position. Fixed curved bedding and pillow cavities have been heretofore employed within the recess of the storage unit in which the bed is stored in vertical position. However, these fixed cavities have occasioned the movement and disarray of the pillow and bedding when the tip-up bed is moved from a horizontal to a vertical position and oft times the jamming or catching of the pillows and upper parts of the bedding in the cavity when the bed is being moved into and out of the storage position results in inoperability of the overall unit.

SUMMARY

The present invention solves the above problems by providing a flexible bedding and pillow retainer which is flexed by the downward movement of the head upper edge of the mattress as it is tipped on a pivot axis from the horizontal to the vertical. The head upper edge of the mattress slides on the inner surface of a concavely curved rectangular flexible panel and is adapted to flex the panel rearwardly decreasing its radius of curvature as the head edge moves downwardly from its horizontal position to a vertical position. The horizontal edges along the width of the flexible panel are freely movable in a pair of open channels freely holding the bottom and top horizontal edges of the panel. The panel moves generally horizontally under the inwardly pressing action of the head upper edge of the moving mattress. The curved retainer panel has a concave surface facing the pivoting mattress and bed. The panel has a radius of curvature greater than the pivot axis of curvature of the bed and mattress and the centers of curvature of the panel and bed mattress are displaced from one another. The locus of the center of curvature of the panel is aligned linearly with the pivot axis of the bed and mattress and a point along the arc from the mattress head upper edge in the vertical bed mattress position to the lower edge of the panel. As the bed is raised from its horizontal use position the cavity between the back edge of the mattress and the bedding cavity becomes increasingly smaller. This causes the panel to flex further rearwardly and to tension the panel above the moving contact point between the mattress head upper edge and the facing surface of the panel against the pillows and bedding preventing the loose bedding and pillow(s) from falling downwardly or becoming jammed. When lowering the bed, the head upper edge of the mattress scoops the bedding back out of the cavity with the bedding and the pillow being generally in the same position as it entered the cavity as the bed was traversing from the horizontal position to the vertical storage position.

DETAILED DESCRIPTION

Figure 1:
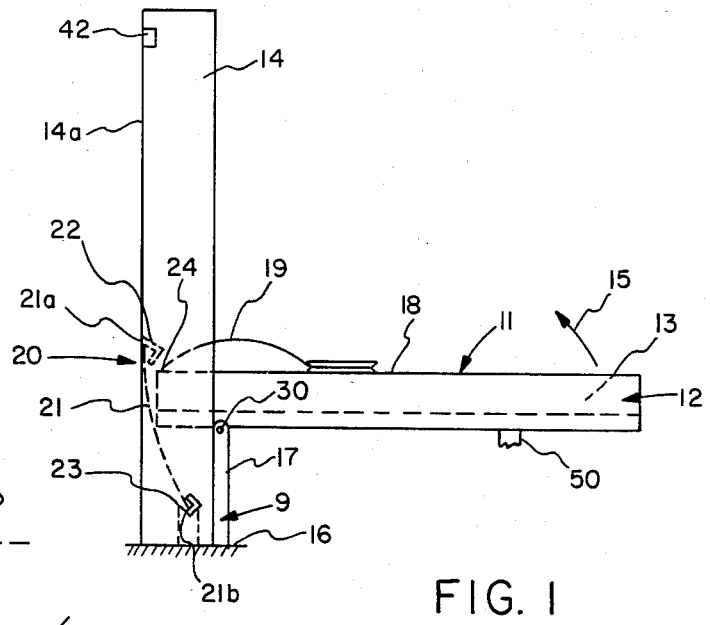
FIG. 1 is a partial side elevation view of the tip-up bed unit in horizontal use position.

FIG. 1 illustrates the combination of a tip-up bed 11 comprising a bed frame 12, mattress 13, and appropriate bedding 18 and pillow(s) 19. Bed 11 is mounted in a storage unit or wall recess 14 and is pivotable from the shown horizontal position to a vertical position around a pivot frame assembly 9 mounting spaced pivots 30 or a torsion bar assembly, as seen in the related application, at the ends 17, 17*a* of the pivot frame. Attached to pivot frame assembly 9 is a bedding and pillow retainer assembly 20 comprising a concavely curved flexible panel 21 held by a pair of top and bottom horizontal open channels 22 and 23. Open channels 22 and 23 face rearwardly at an angle of about 35° from the vertical and 30° from the horizontal toward the inner wall 14*a* of the storage unit 14 or wall recess. The longitudinal edges 21*b* and 21*a* at the bottom and top of panel 21 are freely confined under compression in the open channels 22,23. As the bed 11 is pivoted along arc 15 from the horizontal position to a vertical position around pivots 30 the mattress head upper edge 24 slides downwardly on the front surface 41 of panel 21 and flexes the panel rearwardly toward the rear surface 14*a*. In so doing the pillow 19 and upper portions of the bedding 18 are kept in place by being tensioned and confined in a moving cavity 40 formed between the front surface of panel 21 and the mattress upper portions under the pillow(s).

Storage unit 14 is normally mounted on a floor surface 16. Bed 11 normally includes an appropriate bottom support leg or part 50 extending from the bed frame to the floor as seen in several of the prior art patents. In the related application Ser. No. 603,488 an auxiliary furniture unit such as a table or sofa is attached to the underside of the bed and acts in the bed horizontal position as a support for the cantilevered end of frame 12.

Figure 2:
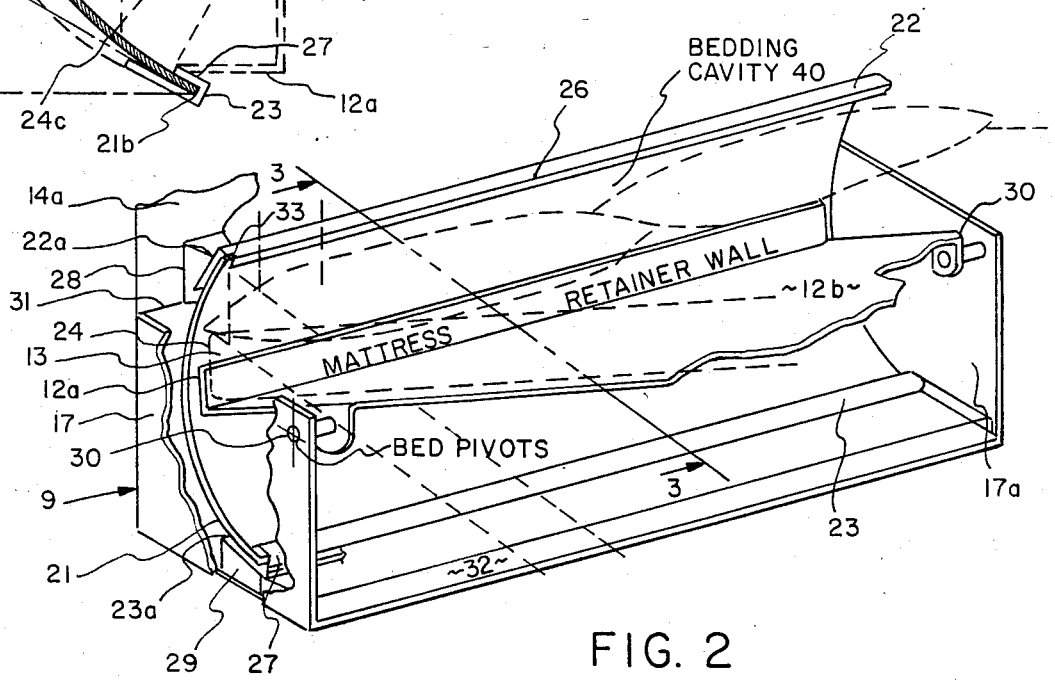
FIG. 2 is a perspective cut-away partial view of the bedding and pillow retainer mounted in a pivot frame supporting a tip-up bed.

FIG. 2 shows the assembly of the panel 21 in channels 22 and 23. The channels are mounted by appropriate angular blocks 28 and 29 to pivot frame 9. Block 28 mounts the rear side of a relatively long leg 22*a* of channel 22 to a bar 31 extending longitudinally from pivot frame side 17 to pivot frame side 17*a*. Bottom channel 23 has a relatively long leg 23*a* mounted to block 29 and block 29 in turn is welded or otherwise attached to a bar 32 of pivot frame 9. Channel 23 may be mounted directly to another transverse bar across the bottom of sides 17, 17*a*. Relatively shorter legs 26, 27 extend parallel to legs 22*a*, 23*a* are connected thereto by a base 33 wider than the thickness of the flexible panel so the panel edges 21*a*, 21*b* can slidingly move in the open channels formed by the legs and base. Bed frame 12 includes a mattress retainer wall 12*a* and a flat mattress support area 12*b*. Mattress 13 thus abuts at its head end retainer walls 12*a* and on its flat bottom surface seats on surface 12*b* of the frame.

The assembly shown in FIG. 2 may be separately manufactured without the specific bed frame 12 and mattress 13 and shipped to a bed or furniture unit manufacturer. Blocks 28 and 29 may be adjustably mounted to the pivot frame so that the bedding retainer can be customized for the particular sized mattress which the bedding manufacturer desires to use with his unit.

Figure 3:
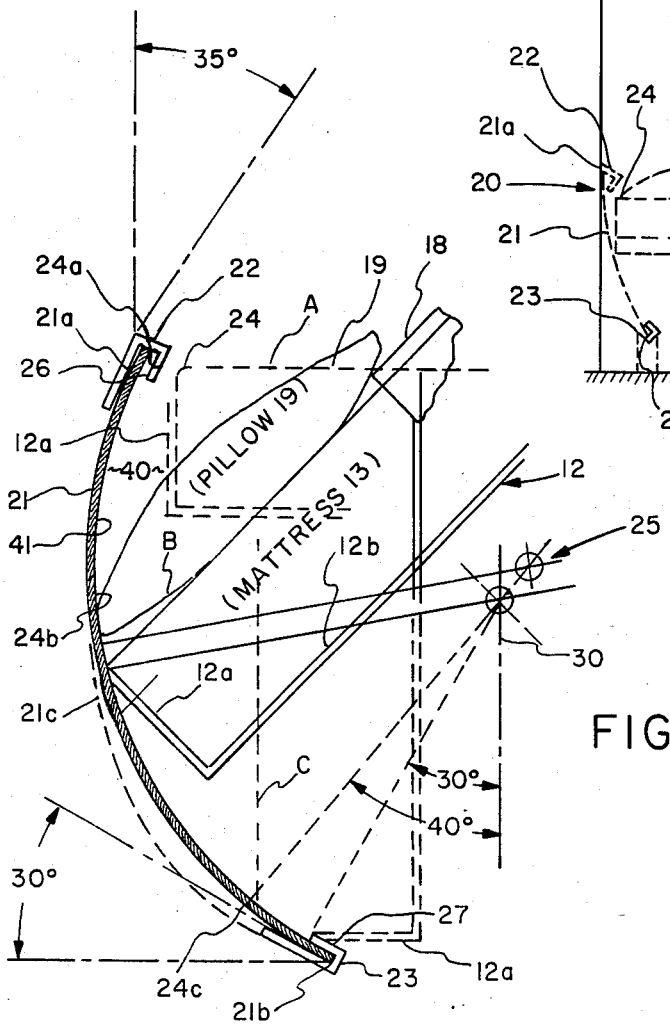
FIG. 3 is a schematic cross-sectional view taken on the line 3—3 of FIG. 2 parallel to the pivot frame ends showing the functioning of the bedding and pillow retainer in various pivot modes of the mattress and bed.

FIG. 3 illustrates the actual functioning of the bedding retainer of the invention. In the bed horizontal position shown as dashed lines A the head of the mattress upper edge 24 which normally will be covered by a fitted bedsheet is spaced about one inch opposite from point 24*a* on fixed channel 22. As the bed moves into full line position B approaching about 45° between the horizontal use and vertical storage positions the mattress head upper edge 24 begins sliding on the outwardly facing surface 41 of panel 21 as at point 24*b* and begins to move the panel rearwardly toward dotted panel portion 21*c*. At this time the upper end 21*a* of the panel slides downwardly in open channel 22 to compensate for the panel rearward movement to dotted position 21*c*. The panel is increased in tension by the increased bending of the panel which decreases the radius of curvature from the center locus of curvature 25. The increase in tensioning of the panel 21 acts outwardly above the moving contact point toward the pillow 19 and bed head end portions of bedding 18 to press and more securely hold the pillow and bedding against the head end surface of the mattress. As the bed passes its upper trajectory to dashed line vertical position C the panel is no longer pushed rearwardly but rather is released from position 21*c* so that panel 21 continues in tension and continues to press on the pillows and upper bedding portions. At position C the mattress upper edge 24 abuts the panel at point 24*c*. At that point 24*c* or the end of leg 27 or at the end 21*b* of panel 21 adjacent thereto or any point on the arc therebetween, the center of curvature 25 of the panel and the pivot axis 30 of the bed are linearly aligned, with the center of curvature 25 being outwardly displaced from the pivot axis 30 a distance of from about ¾ to 1 inch. Thus the linear alignment is in the range of 30° to 40° from the vertical.

Frame 12 includes a rear head-end mattress retainer wall 12*a* and a support platform 12*b* which is pivotably mounted to pivot 30 to support mattress 13. A stop in the form of a horizontal wood bar 42 or the like extends across the storage unit 14 (FIG. 1) to prevent the mattress 13 from flopping rearwardly in the storage recess when the unit is in the vertical storage position.

When it is desired to move the bed unit from vertical position C back to horizontal position A, as the unit leaves point 24*c* where the mattress head upper edge 24 has been compressed against panel 21, edge 24 slides upwardly "scooping" the pillows from cavity 40 as the bed proceeds to position B and position A.

The above description of an embodiment of this invention is intended to be illustrative and not limiting. Other embodiments of this invention will be obvious to those skilled in the art in view of the above disclosure.

I claim:

1. In combination a tip-up bed pivotably movable on a first horizontal pivot axis from a horizontal use position to a vertical storage position and including a mattress, bedding and at least one pillow;

recessed storage means for storing said bed in the vertical position;

an open pillow and bedding cavity within said storage means, said cavity being bounded by an outwardly facing flexible concave panel positioned to abut an upper edge of the head of the mattress as the bed and mattress is moved from a horizontal to a vertical position and said upper head edge passes slidingly downwardly along said panel; and wherein said panel has a radius of curvature greater than the radius of pivot between said first pivot axis and said mattress upper edge and a locus of the center of curvature of said panel is displaced from said first pivot axis such that when said mattress upper edge passes downwardly, said mattress upper edge flexes said panel rearwardly toward a rear portion of said recessed storage means and said panel confining said bedding and pillow in the bedding cavity above said mattress upper edge to securely hold said pillow and bedding against said mattress in the vertical storage position.

2. The invention set forth in claim 1 further comprising spaced upper and lower fixed horizontally-extending open channels, the upper and lower horizontal edges of said flexible panel being freely mounted and confined in said channels and capable of sliding movement within the channels.

3. The invention set forth in claim 2 wherein each of said channels comprises a relatively short front leg, a relatively long rear leg and a base interconnecting said legs, said base having an inner width greater than the thickness of said flexible panel.

4. The invention set forth in claim 3 wherein said channels legs are parallel to each other and form an open channel facing at an angle toward said recess storage means.

5. The invention set forth in claim 2 wherein in the vertical position of said bed, a point on an arc between said mattress upper edge and said lower edge of the panel, said first pivot axis and the locus of the center of curvature of said panel are linearly aligned.

6. A bedding and pillow retainer for a made-up, tip-up bed including a mattress adapted to be stored vertically in a storage recess comprising:

a flexible concavely curved rectangular panel extending laterally across said storage recess, said panel having a height at least extending from a vertical level approximately equal to the position of a top head edge of the mattress in the mattress horizontal position to the position of said top head edge of the mattress in the mattress vertical position; and a pair of open panel-holding horizontally extending panel channels freely holding said flexible panel at horizontal top and bottom edges of said panel, said panel being displaceable toward said storage recess upon downward movement of said top head edge of said mattress to tension and securely hold a pillow and bedding at the head of the bed as the bed is tipped-up.

7. The retainer of claim 6 wherein each of said channels comprising a relatively short front leg, a relatively long rear leg and a base interconnecting said legs, said base having an inner width greater than the thickness of said flexible panel.

8. The retainer of claim 7 wherein said channels legs are parallel to each other and form an open end of said channels facing at an angle toward said recess storage means.

9. The retainer of claim 6 further including means for attaching said channels to a frame containing pivot means for pivotably moving said tip-up bed.

* * * * *